US008002629B2

(12) United States Patent
Bennett et al.

(10) Patent No.: US 8,002,629 B2
(45) Date of Patent: Aug. 23, 2011

(54) GAMING MACHINE WITH INTERACTIVE SCORECARD

(75) Inventors: Nicholas Luke Bennett, Lane Cove (AU); Philippa Graham, Lane Cove (AU); Natalie Bryant, Lave Cove (AU)

(73) Assignee: Aristocrat Technologies Australia Pty Ltd (AU)

( * ) Notice: Subject to any disclaimer, the term of this patent is extended or adjusted under 35 U.S.C. 154(b) by 586 days.

(21) Appl. No.: 11/957,130

(22) Filed: Dec. 14, 2007

(65) Prior Publication Data

US 2008/0096640 A1 Apr. 24, 2008

Related U.S. Application Data

(63) Continuation of application No. 10/181,206, filed as application No. PCT/AU2000/001536 on Dec. 14, 2000, now abandoned.

(30) Foreign Application Priority Data

Jan. 10, 2000 (AU) ..... PQ5009

(51) Int. Cl.
*A63F 9/24* (2006.01)

(52) U.S. Cl. ..... 463/20; 273/138.1

(58) Field of Classification Search ..... 463/12–13, 463/16–18, 22–20, 25–29; 273/138.1, 139, 273/292

See application file for complete search history.

(56) References Cited

U.S. PATENT DOCUMENTS 5,380,007 A * 1/1995 Travis et al. ..... 463/18
5,494,287 A * 2/1996 Manz ..... 273/143 R
5,779,547 A * 7/1998 SoRelle et al. ..... 463/28
6,053,813 A 4/2000 Mathis
6,135,884 A * 10/2000 Hedrick et al. ..... 463/20

FOREIGN PATENT DOCUMENTS

| | | |
|---|---|---|
| AU | 589158 | 10/1989 |
| DE | 3426430 | 1/1986 |
| EP | 0219305 | 4/1987 |
| EP | 0443420 | 8/1991 |
| EP | 0444932 | 9/1991 |
| EP | 0449433 | 10/1991 |
| GB | 2086632 | 5/1982 |
| WO | 9624421 | 8/1996 |
| WO | 9815928 | 4/1998 |

OTHER PUBLICATIONS

PCT International Search Report, PCT/US 97/17311, Jan. 22, 1998.
PCT International Search Report, PCT/AU00/01536, Mar. 9, 2001.
Derwent Abstract Accession No. 86-029682/05, DE 3426430A (Gauselmann) Jan. 23, 1986.

* cited by examiner

*Primary Examiner* — Dmitry Suhol
*Assistant Examiner* — Alex F. R. P. Rada, II
(74) *Attorney, Agent, or Firm* — McAndrews, Held & Malloy, Ltd.

(57) ABSTRACT

A gaming machine (10) includes a controller for controlling operation of the machine (10), a primary display (16) is provided on which a game to be played is displayed. A secondary display (18) is also provided on which a scorecard (22), indicating prizes to be paid upon a winning game being achieved, is displayed. The game and the scorecard (22) are controlled by the controller and the scorecard (22) is a dynamic scorecard (22) with the relationship between combinations of symbols constituting a winning game and the prizes awarded by the scorecard (22) for that particular game changing from game to game.

24 Claims, 9 Drawing Sheets

GAMING MACHINE WITH INTERACTIVE SCORECARD

RELATED APPLICATIONS

This application claims priority to and benefit as a continuation of U.S. patent application Ser. No. 10/181,206, filed on Jul. 10, 2002, entitled "Gaming Machine With Interactive Scorecard," which is herein incorporated by reference in its entirety.

FIELD OF THE INVENTION

The present invention relates to a gaming machine of the type known as a slot machine or fruit machine. Generally, these types of machines have a series of rotatable reels each of which displays a series of symbols or a video simulation of such a mechanism while other types of machines are arranged to play video simulations of card games or other types of wagering games, such as bingo or keno. More particularly, the invention relates to an improvement to a game played on such a machine.

BACKGROUND TO THE INVENTION

Players regularly playing gaming machines quickly tire of particular games. Therefore, it is necessary for manufacturers of these machines to develop inventive game features which add interest to the games provided on such machines in order to keep the players entertained and willing to continue to play the games. Gaming machines of the type described are particularly well known nationally and internationally. Substantial amounts of money are wagered on these machines. In the state of NSW and other states of Australia, there is a growing tendency to legalise the use of gaming machines by licensing operators with resulting revenue gains being achieved through license fees and taxation of moneys invested. The licensed operation of gaining machines is the subject of state legislation and regulation. Amongst the items regulated is the minimum percentage payout for a gaining machine. For example, a minimum of 85% of monies invested must be returned as winnings and manufacturers of gaming machines must therefore design their machines around these regulatory controls.

With the growth that has occurred in the gaming machine market, there is intense competition between manufacturers to supply the various existing and new venues. When selecting a supplier of gaming machines the operator of a venue must pay close attention to the popularity of various games with their patrons. Therefore, gaming machine manufacturers are keen to devise games that are popular with players as a mechanism for improving sales and for maintaining player interest. In this regard, various strategies have been tried in the past to make games more enticing to players including an increase in the number of reels, video simulations of such reels secondary features, or the like.

SUMMARY OF THE INVENTION

According to the invention, there is provided a gaming machine which includes:

a control means for controlling operation of the machine;

a primary display means on which a game to be played is displayed; and a secondary display means on which a scorecard, indicating prizes to be paid upon a winning game being achieved, is displayed, the game and the scorecard being controlled by the control means and the scorecard being a dynamic scorecard with at least one of a prize indicated by the scorecard for a particular combination of symbols and a combination of symbols indicated by the scorecard as constituting a prize-winning combination of symbols changing from game to game without player intervention.

In one embodiment of the invention, the scorecard may change depending on the result of a game played. Conversely, the scorecard may affect the result of the game. However, it is not essential that these results occur and changes in the scorecard may be effected independently of any game result and vice versa.

An animated character may implement changes to the scorecard.

It is believed that with a dynamic, interactive scorecard of the type in question, the game will become more interesting for the player.

The primary and secondary display means may be displayed on a single screen of the gaming machine. Instead, the primary display means may be displayed on one screen with the secondary display means being displayed on a second screen. For example, the second screen may be arranged in a top box of the gaming machine.

BRIEF DESCRIPTION OF THE DRAWINGS

The invention is now described by way of example with reference to the accompanying drawings in which.

DETAILED DESCRIPTION OF THE DRAWINGS

Figure 1:
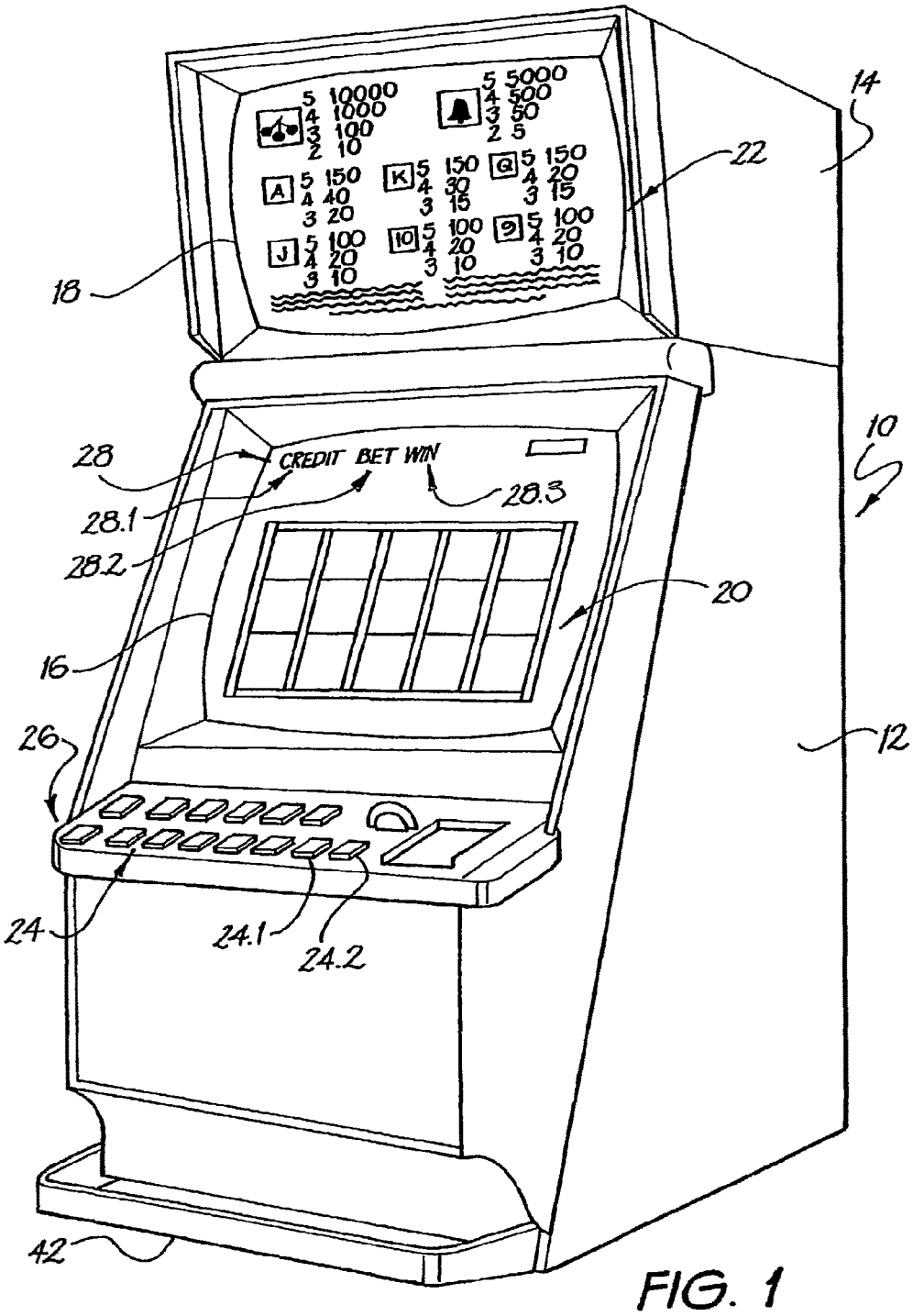
FIG. 1 shows a three dimensional view of a gaming machine, in accordance with the invention.

In the drawings, reference numeral 10 generally designates a gaming machine, in accordance with the invention. The gaming machine 10 includes a console 12 on which a top box 14 is mounted.

A first video display unit or screen 16 is mounted in the console 12 and a second video display unit or screen 18 is mounted in the top box 14. A game 20, in use, is displayed on the screen 16 and a scorecard (also sometimes referred to as a paytable) 22 is displayed on the screen 18.

The game 20 is of the type simulating rotating wheels, card games, other games of chance such as bingo or keno, or the like. For ease of explanation, the game 20 will be described with reference to a video simulation of rotating reels.

The game 20 displayed on the screen 16 is controlled by means of buttons 24 arranged in a midtrim 26 of the gaming machine 10. Various operations are effected by the buttons 24 such as, via buttons 24.1 and 24.2, the number of lines to be bet and the number of credits to be bet, respectively. Various meters 28 are also displayed on the screen 16. A first meter 28.1 indicates the credits available to the player as a result of previous wins. A meter 28.2 shows the bets made by the player for a particular game or games and a meter 28.3 shows the amount won by the player as a result of a winning combination of symbols in the game 20.

Figure 2:
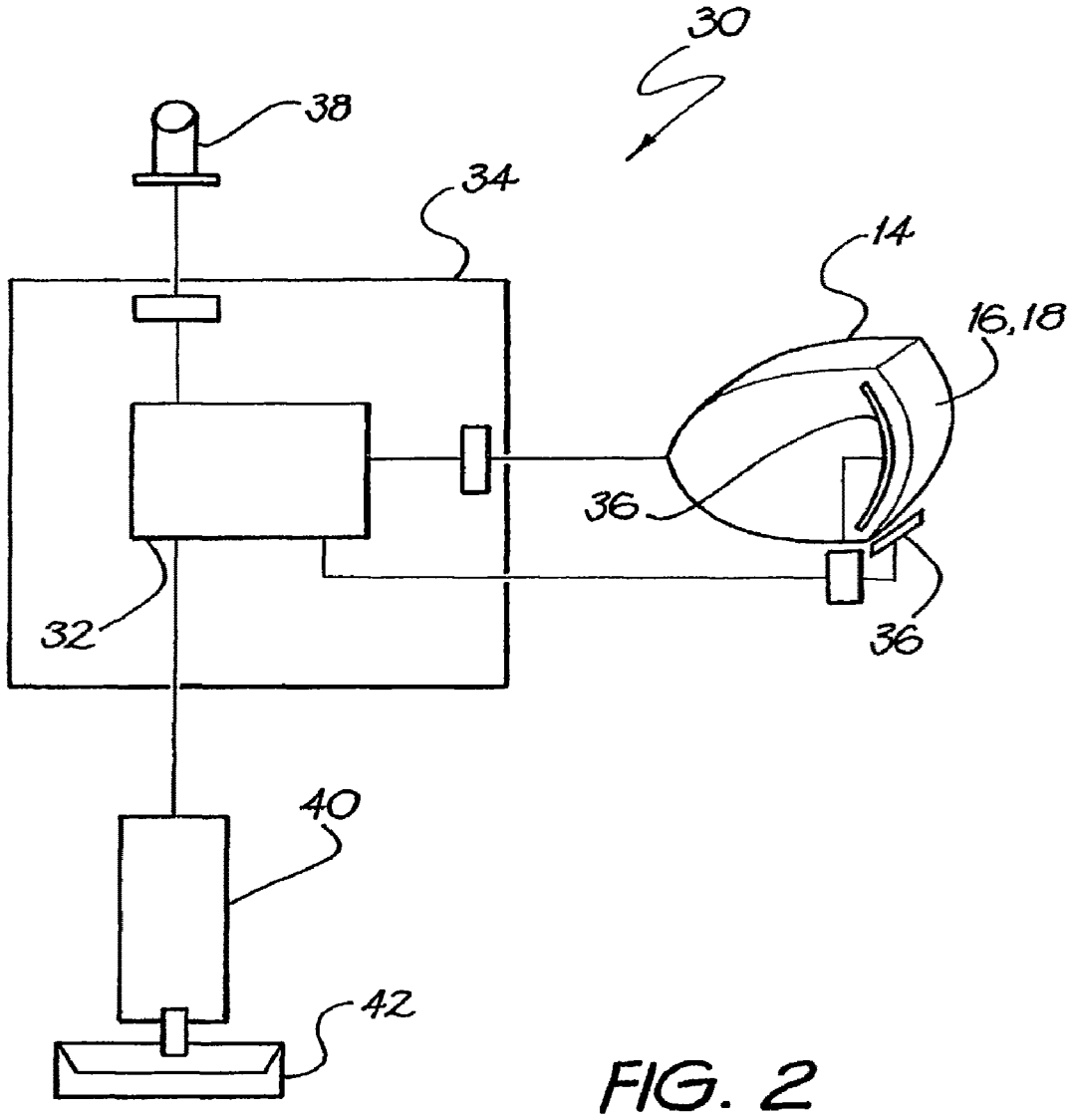
FIG. 2 shows a block diagram of a control circuit of the gaming machine.

A control system 30 of the gaming machine 10 is illustrated in FIG. 2 of the drawings. A program which implements the game 20 and the scorecard 22 is run on a processor 32 of the control system 30. The processor 32 forms part of a controller 34 which drives the screens 16 and 18 and which receives input signals from sensors 36. The sensors 36 include touch sensors mounted at least in the screen 16 and, optionally, in the screen 18. The sensors 36 cooperate with the buttons 24 for causing the reels of the game 20 to be "spun". It will be appreciated that, instead of the buttons 24, a pull handle (not shown) arranged on a side of the console 12 of the machine 10 could be provided.

The controller 34 also receives input pulses from a mechanism 38 indicating that the player has provided sufficient credit to begin playing. The mechanism 38 may be a coin input chute, a bill collector, a credit card reader, or other similar types of validation devices. Finally, the controller 34 also drives a payout mechanism which, for example, may be a coin output for feeding coins to a coin tray 42.

As indicated above, the scorecard 22 is a dynamic scorecard controlled by the control system 30. In other words, the scorecard 22 is integrated into a part of the game 20 although control of the scorecard 22 may be effected independently of the result of the game 20. It is also possible that events happening either consecutively or simultaneously on the game 20 can affect the scorecard and vice versa. It is also intended that the scorecard 22 determines winning outcomes which may not necessarily be combined with the result of the primary game.

Various embodiments of the dynamic scorecard 22 will now be described.

Figure 3:
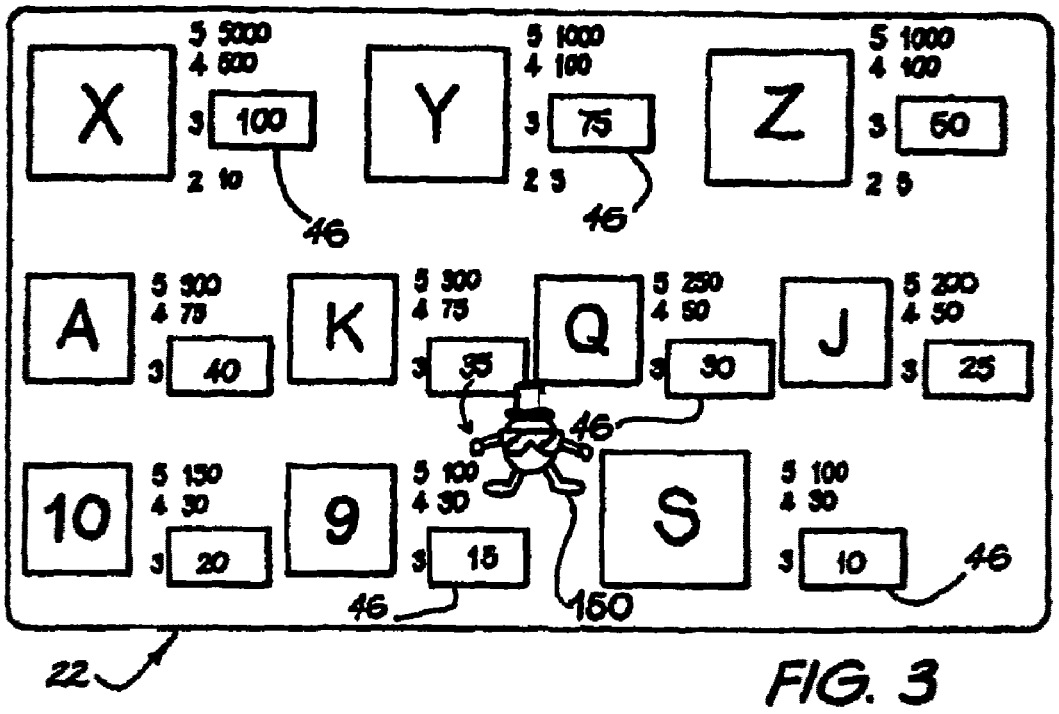
FIG. 3 shows a schematic representation of a scorecard of the gaming machine in its initial condition, in accordance with one embodiment of the invention.
Figure 4:
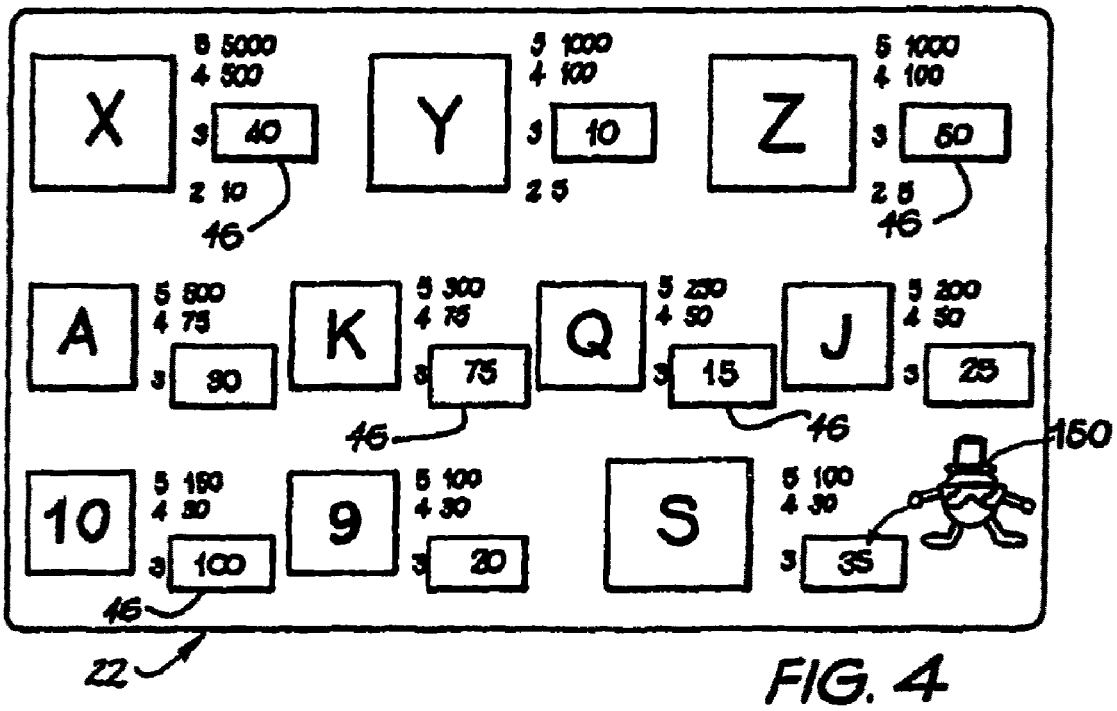
FIG. 4 shows the scorecard of FIG. 3 after completion of the game played on the gaming machine.

Referring firstly to FIGS. 3 and 4 of the drawings, a first embodiment of the scorecard 22 is illustrated.

This embodiment of the scorecard 22 involves the prizes awarded as a result of a prize winning combination having been achieved on the game 20 being shuffled around the scorecard 22 so that the prizes associated with each combination or a subset of the combinations will change. This shuffling of the prizes may happen with every game or, instead, may only happen as a special feature where a specific trigger combination results in the prizes being shuffled either once or a predetermined number of times, for example, for the next ten games.

The shuffling of the prizes on the scorecard 22 may either be random in that each prize could potentially end up being associated with any one of the applicable combinations or the method by which the shuffling occurs may be fixed, for example, the prizes could always move clockwise by one position or a five of a kind combination may swap with a four of a kind combination of the same symbol. Still further, a combination of random and fixed methods could be used such as where the prizes for each combination of a specific symbol always swap randomly with each other only or five of a kind prizes may be shuffled amongst themselves only.

Still further, the prize shuffle may relate to the entire scorecard 22 or to only a portion of the scorecard 22. For example, there may be a special symbol for which the prizes for each combination will be the only ones that shuffle. Instead, the five of a kind prizes may shuffle over the entire scorecard.

In the embodiment illustrated in FIGS. 3 and 4 of the drawings, the three of a kind prizes, illustrated at 46, swap positions randomly in respect of each game. As the reels on the screen 16 spin, the prizes for the three of a kind combination 46 shuffle continuously around all of the three of a kind combination positions moving very quickly so that none of the applicable prizes remain in position for more than a fraction of a second. When the reels on the screen 16 stop spinning, the prizes come to rest in their final positions and if a three of a kind combination exists as a result of the game 20 on the screen 16, the prize paid will be according to the prize which stopped alongside the relevant winning combination. For example, on the initial scorecard illustrated in FIG. 3 of the drawings, the prize paid for three of a kind for symbol "10" was 20 credits. After completion of the shuffling, the prize paid for three of a kind of the symbol "10" is 100 credits.

Figure 5:
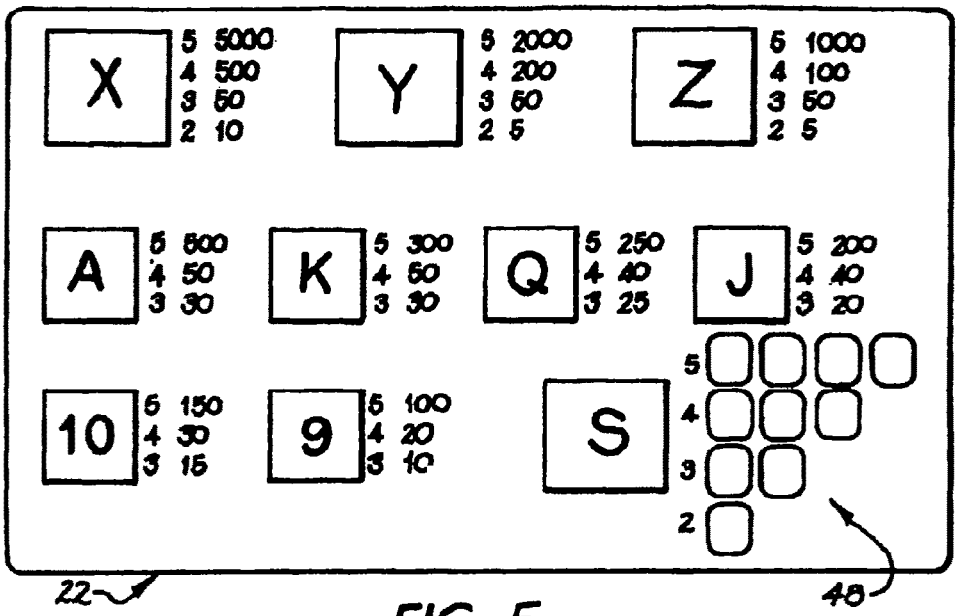
FIG. 5 shows a schematic representation of a scorecard, in an initial condition, in accordance with another embodiment of the invention.
Figure 6:
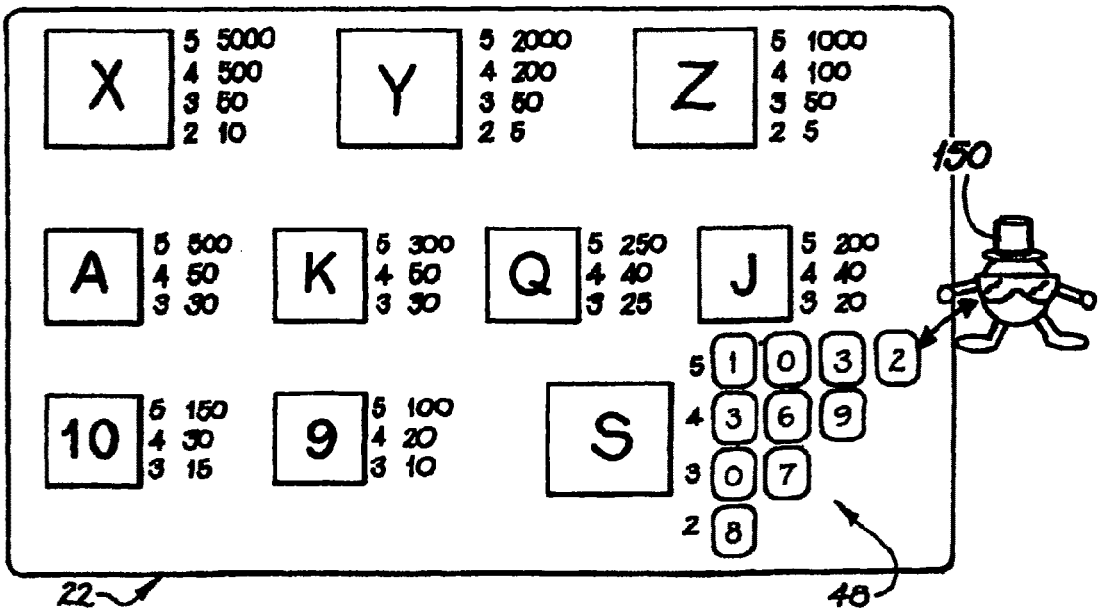
FIG. 6 shows a completed condition of the scorecard of FIG. 5.

Referring now to FIGS. 5 and 6 of the drawings, another embodiment of the scorecard 22 is shown in an initial condition and a completed condition, respectively.

In this embodiment, the prize for a given combination is always completely independent of the prize for another combination. The prizes for all of, or a subset of, the prize combinations are random. As for the embodiment described with reference to FIGS. 3 and 4 of the drawings, the random prizes could occur every game or as feature triggered by a specific event.

The random prizes in this embodiment are preferably selected from different ranges depending upon the combination to which they apply. This can be achieved by using spinning reels on the screen 18 to display the prizes on the scorecard 22 with the number of reels and digits displayed on the reels varying depending on the combination to which they apply. For example, a five of a kind win for a top symbol can be guaranteed to give a prize of at least 4 digits by using 4 spinning reels with no zero on the first reel. Also, for added player suspense, the spinning reels that represent the prizes stop in order from right to left instead of from left to right.

One implementation of this embodiment (not illustrated) is where spinning reels are used in respect of all of the prizes. When the game 20 commences on the screen 16, the reels constituting the scorecard 22 also commence spinning. They continue to spin as each of the reels on the screen 16 stop spinning. For every prize winning combination that was spun up on the reels of the screen 16, the appropriate scorecard reels will stop spinning one by one and reveal the appropriate prize. Prizes for combinations that were not revealed on the screen 16 are not relevant and hence do not need to be revealed on the screen 18.

In the embodiment shown in FIGS. 5 and 6 of the drawings, only prizes in respect of the scatter symbol "S" are variable and constituted by spinning reels 48. In FIG. 5, the layout of the reels 48 for the scatter symbol "S" are shown. In FIG. 6, the layout is shown after completion of a game 20 on the reel 16. Thus, for four of a kind of the symbol "S", a prize of 369 credits is paid.

Figure 7:
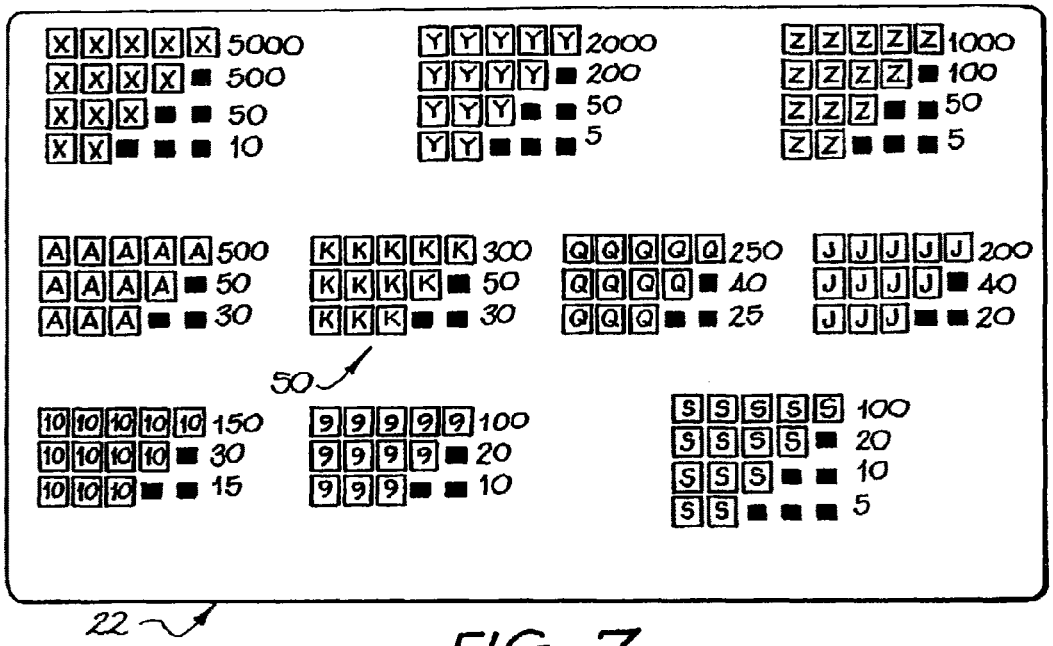
FIG. 7 shows a schematic representation of a scorecard of the gaming machine, in accordance with a further embodiment of the invention, the scorecard being in an initial condition.
Figure 8:
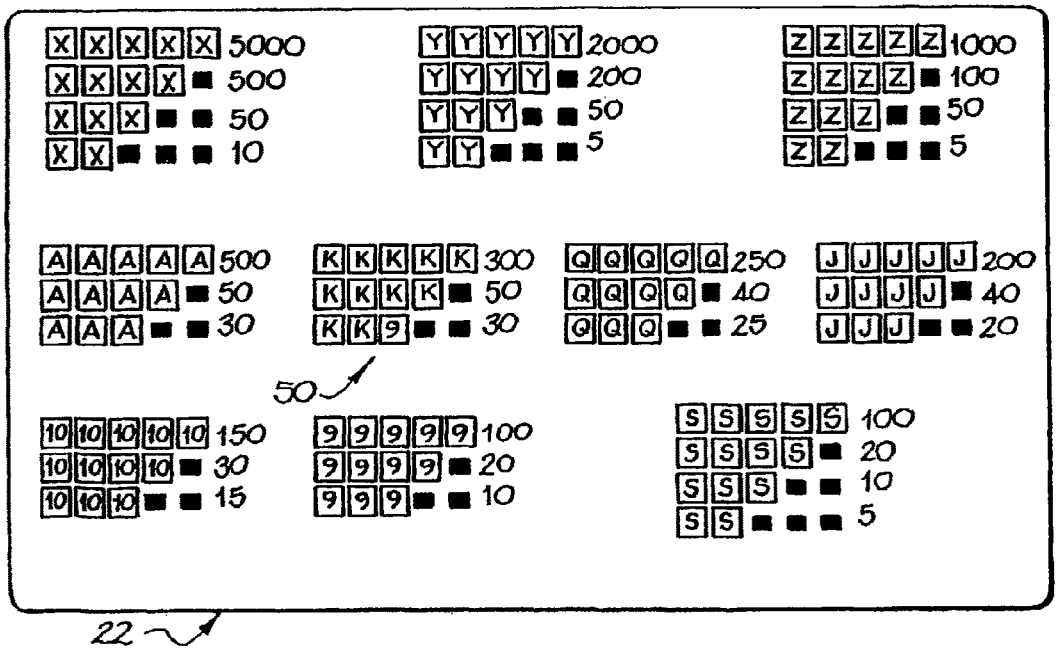
FIG. 8 shows the scorecard of FIG. 7 in a completed condition.

Referring now to FIGS. 7 and 8 of the drawings, a further embodiment of the scorecard 22 is shown. In this embodiment, the prize reels concept is extended to allow symbol combinations themselves to be variable. The example illustrated is for a near-miss opportunity to give a second chance at a winning combination by somehow changing the winning combinations of the scorecard 22, for example, by re-spinning the reels on the screen 18 constituting the scorecard 22. In so doing, the chances are improved that a near-miss will result in a winning payout.

Thus, as illustrated in FIG. 7 of the drawings, the prize for a combination of 3×K is 30 as shown at 50 in FIG. 7 of the drawings.

If a game 20 is played on the screen 16 which results in a combination of K.K.9.-.- coming up on a payline, it is regarded as a "near-miss" of 3×K. Hence, the third king in the same combination on the scorecard 22 will re-spin for a chance at revealing a 9 as shown in FIG. 8 of the drawings and hence allowing the player to be paid for the near-miss scenario.

The same principle can also be applied to a "spin-for-five" type concept. For example, the player may spin up a four of a kind combination on a payline of the game 20 on the screen 16. Then, instead of the fifth reel of the game 20 being spun again, the fifth reel of the scorecard 22 is spun. If the symbol displayed on the fifth reel of the scorecard 22 then corresponds with the fifth symbol on the payline of the game, the prize for five of a kind is paid.

Figure 9:
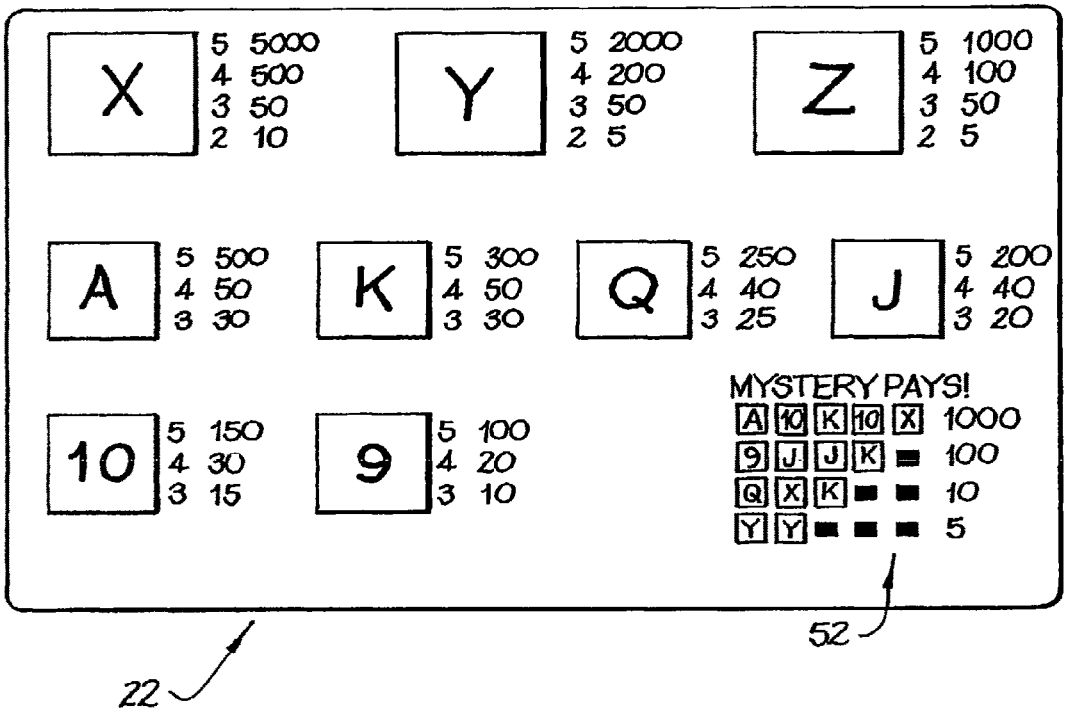
FIG. 9 shows a completed scorecard of the gaming machine, in accordance with still a further embodiment of the invention.
Figure 10:
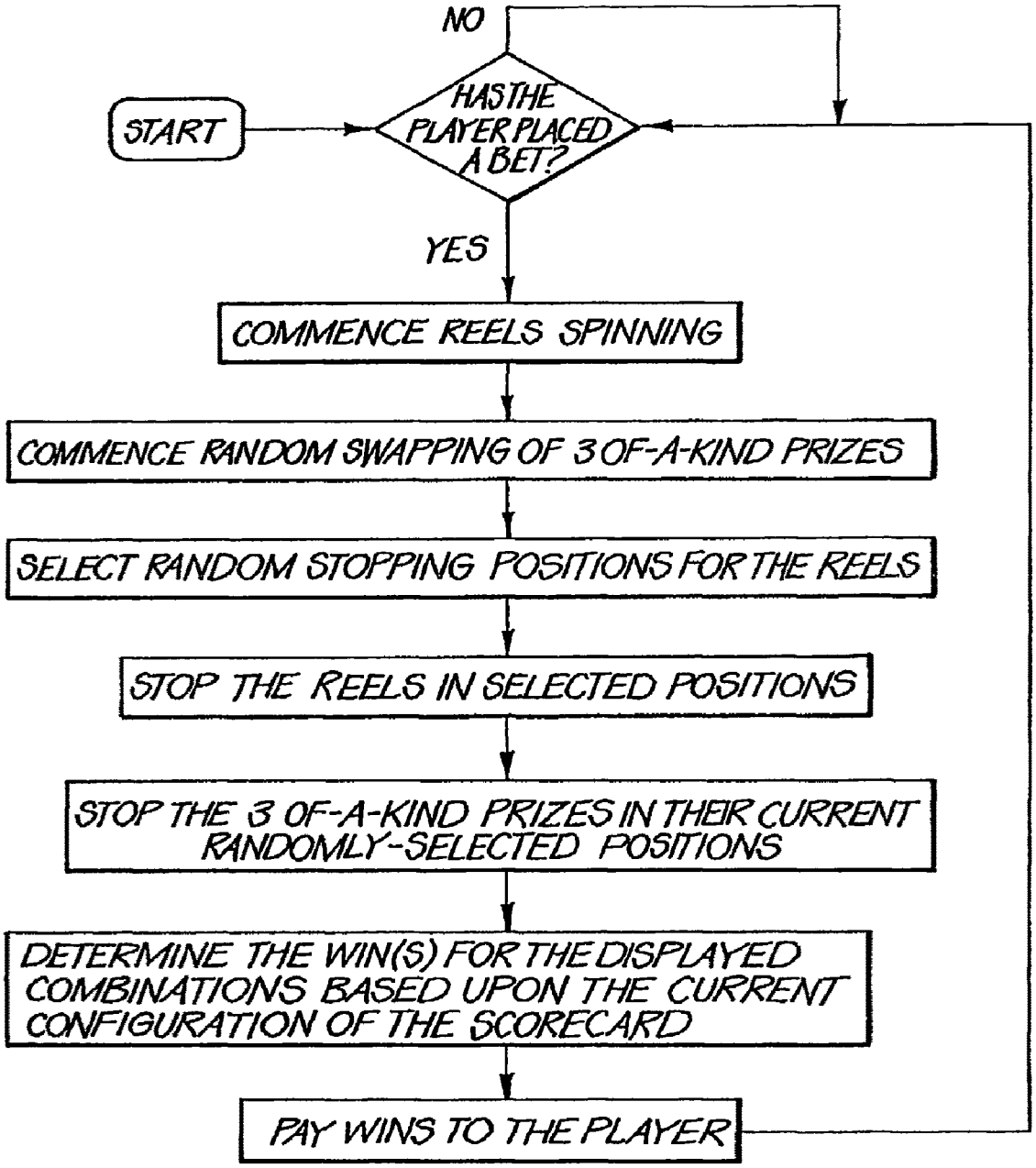
FIG. 10 shows a flow chart of the game of FIGS. 3 and 4.
Figure 11:
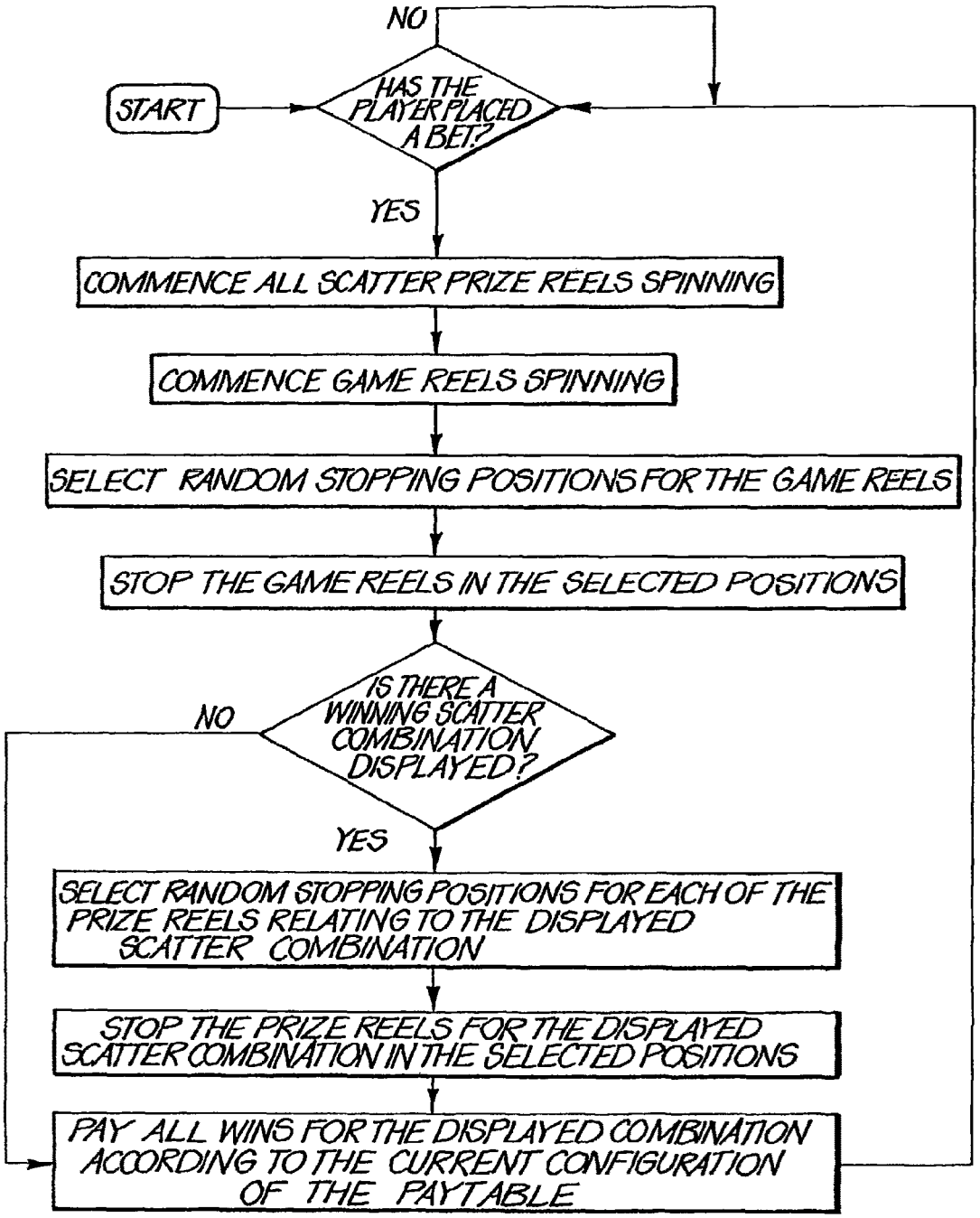
FIG. 11 shows a flow chart of the game of FIGS. 5 and 6.
Figure 12:
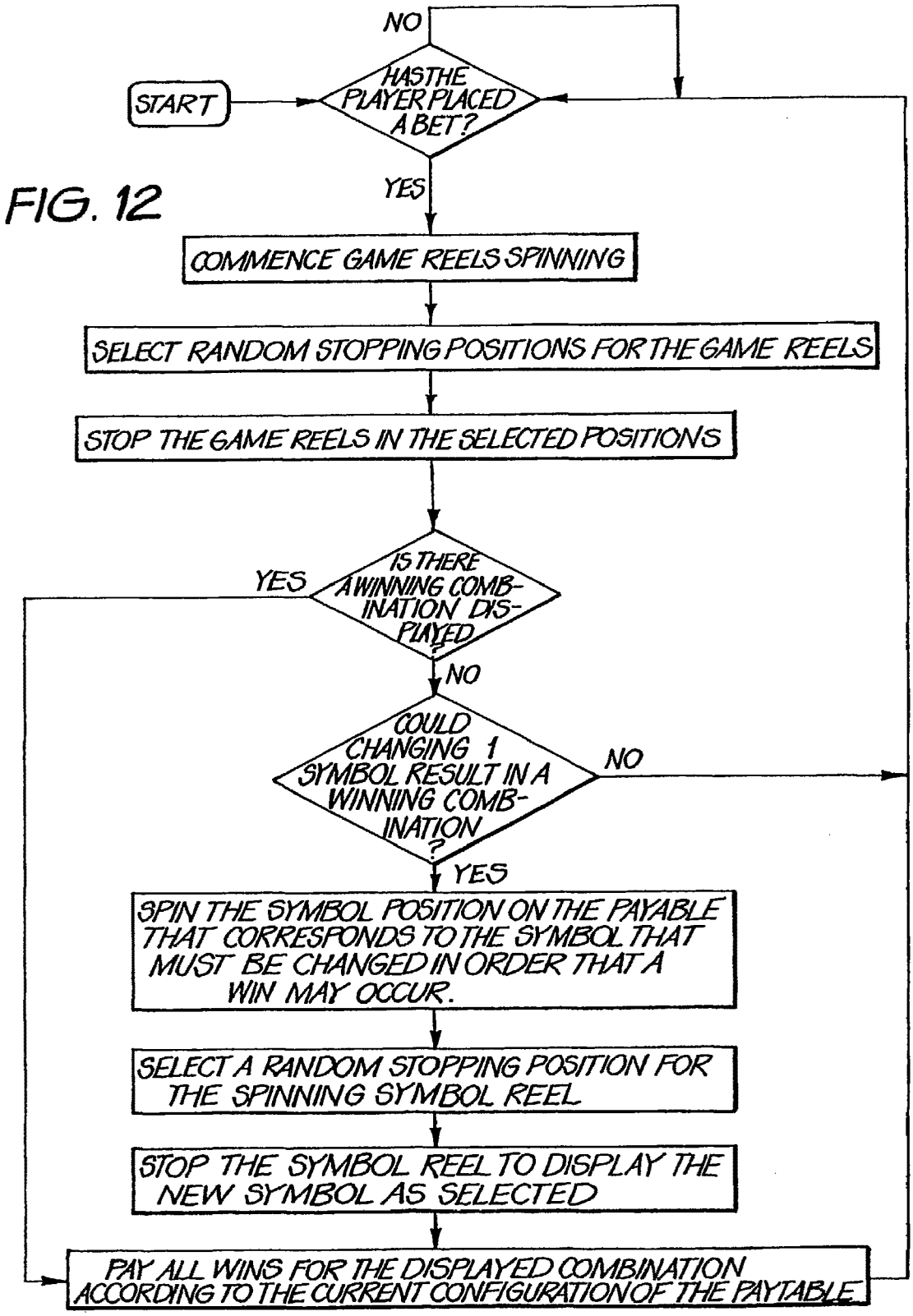
FIG. 12 shows a flow chart of the game of FIGS. 7 and 8.

In the embodiment of the invention shown in FIG. 9 of the drawings, a mystery combination is used as illustrated at 52. This mystery combination 52 is provided in addition to the standard scorecard. The set of prizes awarded will have their symbols vary from game to game. The mystery symbol reels 52 and the scorecard 22 will spin while the reels on the screen 16 in respect of the game 20 spin. After the reels on the screen 16 have stopped spinning, the mystery combination will be revealed by stopping the symbol reels one by one. If a mystery combination 52 matches that on a payline of the game 20 on the screen 16, the appropriate prize will be paid. This feature could be activated for every game 20 or else only for a losing spin of the game 20.

In other embodiments of the invention, the scorecard 22 may pay prizes which are dynamic and vary from game to game. For example, in one game, the prize for 5×K may be an amount which is a multiple of one hundred depending on the prize displayed by the scorecard 22 once the reels on the game 20 stop. This can be implemented either prior to the reels stopping or after stopping of the reels. Thus once 5×K appears on the screen 16 a meter alongside 5×K on the secondary display on the screen 18 increases from one hundred to one hundred x y where y is a value that is randomly chosen. For example, y may be an integer between one and ten.

Further, when a special symbol appears, for example, on the third reel on a centre line of the game 20, a corresponding symbol appears on the screen 18 and randomly indicates a combination. If, for example, the symbol on the screen 18 indicates 5×Q on the scorecard 22, the reels of the game 20 are then re-spun so that 5×Q are displayed with the resultant prize paid.

Also, the scorecard 22 on the screen 18 could indicate the type of pay from game to game played on the screen 16. For example, the scorecard 22 could indicate that for one game the payout will be from left to right on the screen 16. In another game the payout will be from right to left on the screen 16 and in yet another game the payout will be either way, etc.

It will be appreciated that, instead of spinning reels on the scorecard 22, an animated character, such as the applicant's "Mr Cashman", generally shown in an exemplary manner in FIGS. 3 and 4 by 150, could be used to implement changes on the scorecard 22. Thus, rather than spinning reels on the scorecard, Mr Cashman 150 may manipulate the scorecard by throwing numbers/symbols, painting them on, carrying them around, or similar.

Hence, it is an advantage of the invention that a gaming machine 10 is provided which has an interactive dynamic scorecard resulting in more entertainment for players of the machine 10.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming machine comprising:

a controller for controlling operation of the machine;

a primary display on which a game to be played is displayed;

a secondary display on which a scorecard, indicating prizes to be paid upon a winning game being achieved, is displayed, the game and the scorecard being controlled by the controller; and a dynamic scorecard with a combination of symbols indicated by the scorecard as constituting a prizewinning combination of symbols, said symbols randomly changing from game to game without player intervention, and wherein the dynamic scorecard is configured to indicate a plurality of prizes corresponding to a respective combination of symbols and wherein the prize corresponding to a plurality of combinations of symbols is changed by shuffling the correspondence between prizes and respective combinations of symbols from game to game.

2. The gaming machine of claim 1, and in which the combination of symbols of said scorecard changes depending on the result of a game played.

3. The gaming machine of claim 1, and in which the scorecard affects the result of the game.

4. The gaming machine of claim 1, and in which changes in the scorecard affects the result of the game.

5. The gaming machine of claim 1, and further including an animated character, said animated character being displayed on said second display and indicates changes to the scorecard.

6. The gaming machine of claim 1, and in which the game and the scorecard are displayed on a single screen of the gaming machine.

7. The gaming machine of claim 1, and in which the game is displayed on one screen with the scorecard being displayed on a second screen.

8. The gaming machine of claim 7 in which the second screen is arranged in a top box of the gaming machine.

9. The gaming machine of claim 1 wherein the dynamic scorecard is configured to indicate a plurality of prizes corresponding to a respective combination of symbols and wherein the prize values corresponding to respective combinations of symbols is not determined according to a relative likelihood of each combination of symbols arising in the game.

10. The gaming machine of claim 1 wherein the dynamic scorecard is configured to indicate a plurality of prizes corresponding to a respective combination of symbols and wherein the prize values corresponding to respective combinations of symbols is not determined according to a relative rank of each combination of symbols.

11. The gaming machine of claim 1, and wherein the dynamic scorecard includes a reel configured to indicate at least one part of a prize corresponding to a combination of symbols.

12. The gaming machine of claim 11 wherein the dynamic scorecard includes a plurality of reels configured to a indicate a prize corresponding to a combination of symbols.

13. The gaming machine of claim 11 wherein the dynamic scorecard is configured to indicate a plurality of prizes corresponding to a respective combination of symbols and wherein a prize value associated with a first combination of symbols having a corresponding rank is displayed on a first group of one or more reels, and a prize value associated with a second combination of symbols having a corresponding rank is displayed on a second group of one or more reels, wherein the second combination of symbols has a higher rank than the first group of symbols and the second group of reels includes more reels than the first group of reels.

14. A gaming machine comprising:

a controller for controlling operation of the machine;

a primary display on which a game to be played is displayed;

a secondary display on which a scorecard, indicating prizes to be paid upon a winning game being achieved, is displayed, the game and the scorecard being controlled by the controller; and a dynamic scorecard with a combination of symbols indicated by the scorecard as constituting a prizewinning combination of symbols, said symbols randomly changing from game to game without player intervention, and wherein the dynamic scorecard is configured to indicate a plurality of prizes corresponding to a respective combination of symbols and wherein the prize corresponding to a plurality of combinations of symbols is changed by shuffling the correspondence between prizes and respective combinations of symbols from game to game.

15. A gaming machine of claim 14, and wherein said change from game to game is implemented by an animated display feature.

16. The gaming machine of claim 15 wherein the animated display feature is implemented using one or more animated spinning reels.

17. The gaming machine of claim 15 wherein the prize indicated by the scorecard for a particular combination of symbols is not related to prize value for a given symbol combination as calculated on the basis of the size of a possible prize pool.

18. The gaming machine of claim 15 wherein the animated display feature is implemented by an animated character.

19. The gaming machine of claim 14 wherein the dynamic scorecard is configured to indicate a plurality of prizes corresponding to a respective combination of symbols and wherein the prize values corresponding to respective combinations of symbols is not determined according to a relative likelihood of each combination of symbols arising in the game.

20. The gaming machine of claim 14 wherein the dynamic scorecard is configured to indicate a plurality of prizes corresponding to a respective combination of symbols and wherein the prize values corresponding to respective combinations of symbols is not determined according to a relative rank of each combination of symbols.

21. The gaming machine of claim 14, and wherein the dynamic scorecard includes a reel configured to indicate at least one part of a prize corresponding to a combination of symbols.

22. The gaming machine of claim 21 wherein the dynamic scorecard includes a plurality of reels configured to a indicate a prize corresponding to a combination of symbols.

23. The gaming machine of claim 21 wherein the dynamic scorecard is configured to indicate a plurality of prizes corresponding to a respective combination of symbols and wherein a prize value associated with a first combination of symbols having a corresponding rank is displayed on a first group of one or more reels, and a prize value associated with a second combination of symbols having a corresponding rank is displayed on a second group of one or more reels, wherein the second combination of symbols has a higher rank than the first group of symbols and the second group of reels includes more reels than the first group of reels.

24. The gaming machine of claim 14, and wherein the prize indicated by the scorecard for a particular combination of symbols is not related to prize value for a given symbol combination as calculated on the basis of the size of a possible prize pool.

* * * * *